US007127899B2

(12) United States Patent
Sprouse et al.

(10) Patent No.: US 7,127,899 B2
(45) Date of Patent: Oct. 31, 2006

(54) NON-SWIRL DRY LOW NOX (DLN) COMBUSTOR

(75) Inventors: Kenneth M. Sprouse, Northridge, CA (US); Shahram Farhangi, Woodland Hills, CA (US); Mark D. Horn, Granada Hills, CA (US); David R. Matthews, Simi Valley, CA (US)

(73) Assignee: United Technologies Corporation, Hartford, CT (US)

( * ) Notice: Subject to any disclaimer, the term of this patent is extended or adjusted under 35 U.S.C. 154(b) by 178 days.

(21) Appl. No.: 10/787,430

(22) Filed: Feb. 26, 2004

(65) Prior Publication Data

US 2005/0188703 A1 Sep. 1, 2005

(51) Int. Cl.
*F23R 3/30* (2006.01)

(52) U.S. Cl. ..... 60/776; 60/737

(58) Field of Classification Search ..... 60/776, 60/737, 739; 431/354

See application file for complete search history.

(56) References Cited

U.S. PATENT DOCUMENTS 2,655,787 A 10/1953 Brown
2,930,192 A 3/1960 Johnson
3,877,863 A * 4/1975 Penny ..... 431/75
3,914,096 A 10/1975 Schladitz
4,030,875 A 6/1977 Grondahl et al.
4,072,007 A 2/1978 Sanday
4,141,213 A * 2/1979 Ross ..... 60/39.821
4,628,687 A 12/1986 Strom
4,651,534 A 3/1987 Stroem
4,731,989 A 3/1988 Furuya et al.
4,870,824 A 10/1989 Young et al.
4,928,481 A 5/1990 Joshi et al.
5,000,004 A 3/1991 Yamanaka et al.
5,054,280 A 10/1991 Ishibashi et al.
5,214,912 A 6/1993 Farrauto et al.
5,281,128 A 1/1994 Dalla Betta et al.
5,309,637 A 5/1994 Moriarty
5,319,923 A * 6/1994 Leonard et al. ..... 60/39.23

(Continued)

FOREIGN PATENT DOCUMENTS

DE 100 14 092 9/2000

(Continued)

OTHER PUBLICATIONS

Bernard Lewis, Ph.D., Sc.D. (Cantab.) and Guenther von Elbe, Ph.D. (Berlin), Combustion, Flames and Explosions of Gases, Second Edition, Academic Press, 1961, pp. 22-29, 56-65, 330-331.

(Continued)

*Primary Examiner*—William H. Rodriguez
(74) *Attorney, Agent, or Firm*—Harness Dickey & Pierce P.L.C.

(57) ABSTRACT

An air/fuel pre-mixer for a gas turbine combustor and a method of pre-mixing air and fuel for a combustor are provided. In one embodiment the pre-mixer includes a first annular premix fuel manifold disposed upstream of the combustor and an annular member concentric with the first premix fuel manifold. Together the annular premix fuel manifold and the annular member define a first venturi shaped air/fuel pre-mix volume between them that has a throat. At or upstream from the throat, the first premix fuel manifold has a plurality of pores whereby the fuel is injected from the first premix fuel manifold to mix with air in the first pre-mix volume. In another embodiment, the annular member is an outer wall, whereas in yet another embodiment, the annular member is a second premix fuel manifold.

28 Claims, 3 Drawing Sheets

U.S. PATENT DOCUMENTS

| | | | | |
|---|---|---|---|---|
| 5,321,948 | A | 6/1994 | Leonard | |
| 5,395,235 | A | 3/1995 | Lan-Sun Hung | |
| 5,450,725 | A | 9/1995 | Takahara et al. | |
| 5,461,864 | A | 10/1995 | Betta et al. | |
| 5,497,611 | A | 3/1996 | Benz et al. | |
| 5,511,972 | A | 4/1996 | Dalla Betta et al. | |
| 5,512,250 | A | 4/1996 | Dalla Betta et al. | |
| 5,518,697 | A | 5/1996 | Dalla Betta et al. | |
| 5,575,153 | A | 11/1996 | Ito et al. | |
| 5,577,906 | A | 11/1996 | Hanakata et al. | |
| 5,675,971 | A | 10/1997 | Angel et al. | |
| 5,709,077 | A | 1/1998 | Beichel | |
| 5,715,673 | A | 2/1998 | Beichel | |
| 5,836,164 | A | 11/1998 | Tsukahara et al. | |
| 5,899,679 | A | 5/1999 | Euzen et al. | |
| 5,938,427 | A | 8/1999 | Suzuki et al. | |
| 5,956,937 | A | 9/1999 | Beichel | |
| 5,970,702 | A | 10/1999 | Beichel | |
| 6,109,018 | A | 8/2000 | Rostrup-Nielsen et al. | |
| 6,170,264 | B1 | 1/2001 | Viteri et al. | |
| 6,174,159 | B1 | 1/2001 | Smith et al. | |
| 6,182,436 | B1 * | 2/2001 | Prociw et al. | 60/776 |
| 6,189,314 | B1 | 2/2001 | Yamamoto et al. | |
| 6,192,688 | B1 | 2/2001 | Beebe | |
| 6,202,402 | B1 | 3/2001 | Sattelmayer | |
| 6,205,768 | B1 | 3/2001 | Dibble et al. | |
| 6,209,325 | B1 | 4/2001 | Alkabie | |
| 6,289,667 | B1 | 9/2001 | Kolaczkowski et al. | |
| 6,302,683 | B1 | 10/2001 | Vestin et al. | |
| 6,334,309 | B1 | 1/2002 | Dean et al. | |
| 6,358,040 | B1 | 3/2002 | Pfefferle et al. | |
| 6,386,862 | B1 | 5/2002 | Fujita et al. | |
| 6,415,608 | B1 | 7/2002 | Newburry | |
| 6,520,769 | B1 | 2/2003 | Tachihara et al. | |
| 6,584,760 | B1 | 7/2003 | Lipinski et al. | |
| 6,595,003 | B1 | 7/2003 | Dalla Betta et al. | |
| 6,612,830 | B1 | 9/2003 | Berry et al. | |
| 6,669,463 | B1 | 12/2003 | Beutel et al. | |
| 6,709,264 | B1 | 3/2004 | Hermann et al. | |
| 6,712,602 | B1 | 3/2004 | Kang et al. | |
| 6,718,772 | B1 | 4/2004 | Dalla Betta et al. | |
| 6,752,623 | B1 | 6/2004 | Smith et al. | |
| 2002/0139119 | A1 | 10/2002 | Touchton et al. | |
| 2003/0056519 | A1 | 3/2003 | Newburry | |
| 2003/0192318 | A1 | 10/2003 | Sprouse et al. | |
| 2003/0192319 | A1 | 10/2003 | Sprouse et al. | |
| 2004/0000146 | A1 | 1/2004 | Inoue et al. | |
| 2004/0003598 | A1 | 1/2004 | Farhangi | |
| 2004/0048211 | A1 | 3/2004 | Martin et al. | |
| 2005/0076647 | A1 * | 4/2005 | Farhangi et al. | 60/776 |

FOREIGN PATENT DOCUMENTS

| | | |
|---|---|---|
| EP | 0 304 707 | 5/1988 |
| EP | 0 889 289 | 6/1998 |
| JP | 58-179730 | 10/1983 |
| JP | 59-107119 | 6/1984 |
| JP | 60-66022 | 4/1985 |
| JP | 60-64131 | 12/1985 |
| WO | WO 02/27243 | 4/2002 |

OTHER PUBLICATIONS

Forman A. Williams, Combustion Theory, The Fundamental Theory of Chemically Reacting Flow Systems, 1965, pp. 186-201.

Catalytica, How it Works, http://www.catalyticaenergy.com/xonon/how_it_works.html, printed Feb. 6, 2002.

* cited by examiner

NON-SWIRL DRY LOW NOX (DLN) COMBUSTOR

FIELD OF THE INVENTION

The present invention relates to air/fuel pre-mixers for combustors, and more particularly to non-swirl air/fuel pre-mixers for stationary gas turbine combustors.

BACKGROUND OF THE INVENTION

The U.S. stationary power industry is continually being required to lower its pollution levels, especially those of nitrogen oxide gas (NOx), to very low levels. Currently, the industry standard for NOx emissions ranges from 3 to 20 parts per million (ppm). However, federal and state environmental protection agencies are now demanding exhaust emission levels to 3 ppm or below in most areas of the country. Thus, a combustor delivering NOx levels below 1 ppm would likely become certified as the "Best Available Technology" for lowering NOx levels.

Some prior art combustors employ a single central diffusion pilot swirler operating at equivalence ratios between 0.8 and 1.2 surrounded by eight premix swirlers operating at equivalence ratios of approximately 0.4. Other prior art combustors employ multiple large scale (>1.0 inch) swirl injectors and pre-mixers to minimize NOx formation. At best, however, such technology generally obtains NOx emissions as low as 25 ppm. Still other previous devices employ air/fuel premixing within the vanes of a swirler while injecting the pilot fuel from the swirler's center nozzle in order to stabilize the swirler's central diffusion flame. Because the fuel/air mixing distances with these swirler's are lower than those of the other previous devices, this approach can achieve NOx emissions down to about 9 ppm, but no further.

One source of NOx emissions occurs in the high temperature recirculation flame holding zones created by the prior art pilot injectors. These pilot injectors produce the bulk of the combustor's NOx in these flame holder areas. Clearly, such technology falls short of the current upper limit of 3 ppm NOx emissions.

In a typical combustor, air from a multistage axial compressor is discharged radially outward and around the annular combustor. The air flows through the swirl injectors and mixes and burns with the natural gas fuel in the combustor. The combustion product gas is subsequently expanded through a multi-element axial expander (i.e. a turbine) and exhausted to atmosphere.

These swirlers are highly susceptible to acoustic combustion instability. This is because gas turbines require very low air side pressure drops across the combustion chamber in order to maintain high turbine operating efficiencies. Swirler combustors essentially take all of the air-side pressure drop at the axial location of the swirler. Accordingly, the combustion chamber and air plenums within the combustor lack sufficient damping to avoid acoustical instabilities.

Furthermore, pre-mix swirlers are very susceptible to detrimental combustion flashback during turn-down and start-up operation because of their large characteristic dimension (e.g., above 1.0 inch). For proper combustor operation, all combustion is designed to take place downstream of the swirlers where there is sufficient air film cooling and ceramic coatings to protect the combustor walls. Flashback, via the associated internal combustion in the swirler, frequently damages the swirler by overheating it.

Another problem with the previously implemented swirl combustors occurs during power turn-down wherein the overall fuel flow is reduced to equivalence ratios below 0.4. Industry currently handles turn-down operation by shutting off the fuel to selected pre-mix swirlers in order to maintain stable combustion. However, the air from these non-fueled swirlers rapidly mixes with and cools the combustion products from the active pre-mix swirlers before the partially combusted carbon monoxide (CO) can be effectively oxidized to CO2. Hence, during turndown operation, swirler combustors inherently produce excessive amounts of carbon monoxide (well above the adiabatic equilibrium combustion amounts of approximately 3 ppm).

Thus, a need exists to improve the previous combustors, particularly with regard to NOx and CO emissions. Additionally, a need exists to reduce, or eliminate, the acoustic instabilities and flashback that conventional combustors suffer from. Furthermore, a need exists for the capability to burn essentially pure hydrogen fuel having very high air premix flame speeds to reduce the occurrence of detrimental flashbacks and burnouts known to occur in conventional swirler injectors.

SUMMARY OF THE INVENTION

An improved pre-mixer for a gas turbine combustor and a method of pre-mixing air and fuel for a combustor are provided by the present invention. The improved "non-swirl" combustors described herein eliminate the acoustical instabilities and flashbacks associated with the previous devices. The new combustors provided by the present invention employ multi-element, microfine injector technology adapted herewith for turbine combustor applications. Moreover, the present invention provides NOx and CO emissions as low as 3 ppm and 5 ppm, respectively, at full power and even at low turndown ratios as low as 5 and 10 ppm respectively.

In one embodiment, the pre-mixer includes a first annular fuel manifold disposed upstream of the combustor and an annular member concentric with the first fuel manifold. Together the annular fuel manifold and the annular member define a first venturi shaped air/fuel pre-mix volume between them that has a throat. At or upstream from the throat, the first fuel manifold has a plurality of pores whereby the fuel is injected from the first fuel manifold to mix with air in the first pre-mix volume. In another embodiment, the annular member is an outer wall, whereas in yet another embodiment, the annular member is a second fuel manifold.

In yet another embodiment, the present invention provides a fuel injector that includes a first annular premix fuel manifold disposed upstream of the combustor and an annular member concentric with the first premix fuel manifold. Together the annular premix fuel manifold and the annular member define a first venturi shaped air/fuel pre-mix volume between them that has a throat. At or upstream from the throat, the first premix fuel manifold has a plurality of pores whereby the fuel is injected from the first premix fuel manifold to mix with air in the first pre-mix volume. In another embodiment, the annular member is an outer wall, whereas in yet another embodiment, the annular member is a second premix fuel manifold.

In another form, the present invention provides a method of pre-mixing air and fuel for a gas turbine combustor. The method includes defining a first vortex shaped pre-mix volume between a first annular premix fuel manifold and an annular member. When formed the first pre-mix volume has a throat. Additionally, the method also includes injecting fuel from the first premix fuel manifold through a plurality of pores in the first fuel manifold at or upstream of the throat and mixing the fuel with air in the pre-mix volume.

The features, functions, and advantages can be achieved independently in various embodiments of the present inventions or may be combined in yet other embodiments.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

The current invention solves the high NOx and superequilibrium CO emission, acoustic instability, and flashback problems associated with the previous combustors by employing numerous small scale (less than 0.150-in.) non-swirl multi-element pre-mix injectors. In accordance with the principles of the present invention these injectors also incorporate diffusion pilots.

Additionally, by maintaining very low mixing lengths within a single diffusion pilot, and among multiple diffusion pilots, the present invention minimizes the high temperature recirculation flame holding zones of the pilots. Additionally, the present invention also provides adequate flammability and flame stabilization for the combustor system while minimizing those holding zones.

Moreover, rather than using all of the air side pressure drop through the combustor at one discrete axial location (i.e., in the turning vanes), the present invention spreads the pressure drop across the entire length of the air feed system. Accordingly, the distributed pressure drop provides greater acoustic stability margin. Moreover, the pre-mixers provided by the present invention utilize small hydraulic diameters that are below the fuel/air premix quenching distance to thereby prevent flashback.

Figure 1:
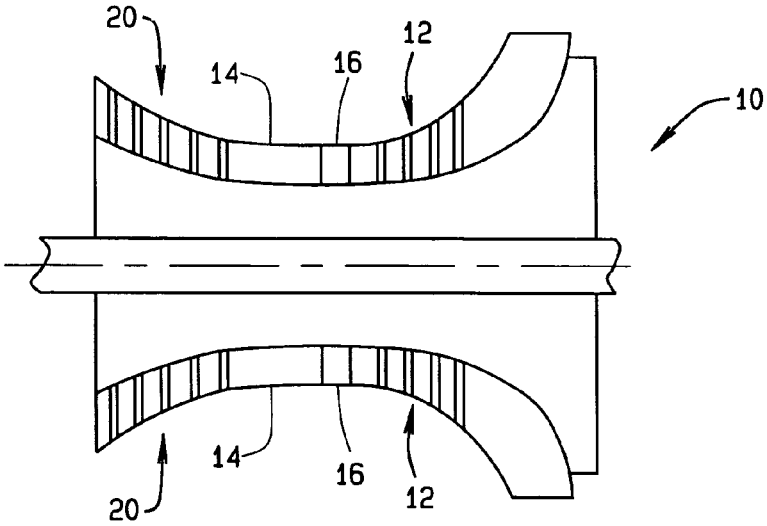
FIG. 1 PRIOR ART
FIG. 1 is a cross sectional view of a turbine combustor in accordance with a preferred embodiment of the present invention.

Referring now to the Figures in general. FIG. 1, illustrates a prior art gas turbine. The gas turbine includes, a compressor 12, a combustor including a combustion chamber 14 and an air/fuel pre-mixer 16, and a turbine, or expander, 20. Alternatively, a fuel injector could be utilized in place of the air/fuel pre-mixer 16. Air flows from the multi-stage compressor 12 (right side of the turbine shaft), is discharged into the combustor air/fuel pre-mixer 16 and mixes with fuel that may be hydrogen. From the pre-mixer 16 the air/fuel mixture flows into, ignites in, and burns in the combustion chamber 14. The combustion product gas is subsequently expanded through the multi-element axial expander 20 (i.e. a turbine) and exhausted to atmosphere.

Figure 2:
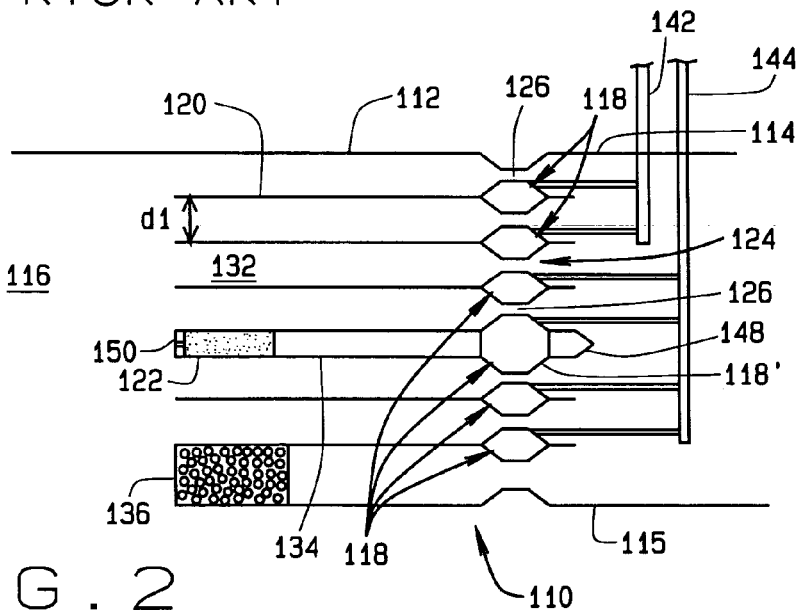
FIG. 2 is a detailed view of a fuel injector of the combustor of FIG. 1.

In accordance with the principles of the present invention, FIG. 2 generally illustrates an alternative preferred embodiment of a multi-element injector, or pre-mixer. The injector uses a large number of mixing annuli with a gap size selected based upon the quenching distance of the air/fuel mixture to ensure that detrimental flashbacks within the premix structure can not occur. One preferred embodiment includes gaps on the order of 0.150-in. In the alternative, for fuels such as hydrogen that have very small quenching distances below 0.060-in., a honeycomb structure insert within the annuli may be incorporated to achieve the desired smaller hydraulic diameters.

In another preferred embodiment, the pre-mixer itself is approximately 2-in. (50.8 mm) long to provide adequate mixing length for the fuel injected into the annuli at the upstream venturi throat location. It should be noted that the cross-sectional flow area at the air's venturi location is sized to ensure uniform air flux over the annuli's radial direction while providing adequate manifold volume for the pre-mix fuel manifolds. Moreover, the air velocity at the venturi throat is lower than the air velocities found in the turning vanes of previous swirlers. Accordingly, the present invention improves the pressure distribution through the combustor. Additionally, the venturi geometry may provide for pressure recovery so that a significant amount of the air side pressure drop can be used within the downstream annuli as well as in the upstream air plenum surrounding the combustor liner.

In another preferred embodiment, the present invention provides a system capable of low emissions even during turn down operation. Accordingly, FIG. 2 shows two fuel supplies feeding the premix injector manifolds to provide for turn down operations. These fuel supplies allow the fuel to be shut off from the outer annuli during combustor turndown so that the central combustor core can continue operating at higher premix equivalence ratios of approximately 0.5. Shutting off the fuel supply to the outer annuli thus keeps the core combustor temperatures high enough to allow for the oxidation of carbon monoxide to carbon dioxide even with the effective turbine expander inlet temperature reduced to below 2000° F. for low power operation.

FIG. 2 also generally shows approximately one pilot annuli for every 4 to 7 premix annuli to provide for system start up. The thickness of the pilot annuli are sized to provide sufficient wakes to cause hot gas recirculation into the pilot fuel jets. Preferably these bluff bodies will have thicknesses on the order of 0.150-in. (3.81 mm) or perhaps greater. Pilot fuel injectors are located along the downstream side of the pilot annuli. The pilot injectors disperse small fuel jets into the pilot's recirculation zones to create hot diffusion flames for lean combustion stabilization. Several types of advantageous fuel injectors are shown in FIG. 3. These pilot injector elements include fan formers, impinging doublets, splash plates and the like. Preferentially, the slots and holes in these elements range from 0.007 to 0.030-in (0.1778 mm–0.762 mm) as described in co-owned, co-pending U.S. patent application Ser. No. 10/729,595, entitled A Catalytic Combustor and Method For Substantially Eliminating Nitrous Oxide Emmisions, filed on Dec. 5, 2003, and Ser. No. 10/729,679, entitled A Fuel Injection Method and Apparatus For a Combustor, and filed on Dec. 5, 2003, which are incorporated herein by reference as if set forth in full.

Turning now to FIG. 2, a preferred embodiment of a fuel injector is illustrated in greater detail. A fuel injector 110 (or pre-mixer) couples to an outer combustor liner 112, or wall, via an outer wall 114 of the injector 110. In particular, the injector 110 is placed in the path of the incoming combustion air and just upstream of the combustion chamber 116. Internally the injector 110 includes one, or more, annular premix fuel manifolds 118 disposed concentrically within the outer wall 114. A corrugated metal sheet 120 extends from each premix fuel manifold 118 toward the combustion chamber 116. Additionally a pilot fuel manifold 122, disposed downstream from the premix fuel manifolds 118, provides the initial flame to ignite the fuel from the premix fuel manifolds 118 and to continue the combustion thereafter.

Each pair of premix fuel manifolds 118 defines a venturi shaped pre-mix volume 124. Of course, the outermost premix fuel manifold 118 and the outer wall 114 may form one of the pre-mix volumes 124. Additionally, the inner wall 115 and the inner most premix fuel manifold 118 may also form a pre-mix volume 124. The pre-mix volume 124 includes a throat 126 at or downstream from a plurality of pores 128 (see FIG. 2A), or holes, in the body of the premix fuel manifold 118. From within an internal bore 130, or passageway, fuel flows from a fuel supply through the pores 128, and to the surface of the premix fuel manifold 118. From the pores 128, the in-flowing combustion air entrains, vaporizes, or otherwise sweeps the fuel toward the throat 126.

Notably, turbulence of the air causes the fuel and air to begin mixing almost immediately. It should also be noted that the venturi shape of the pre-mix volume 124 promotes pressure recovery as the air/fuel mixture emerges from the throat 126. Accordingly, the recovered pressure drop may be distributed elsewhere in the air intake subsystem to allow for improved combustion stability.

Once beyond the premix fuel manifolds 118, the partially mixed air and fuel flows into the extended annular premixing volumes 132 between adjacent sheets 120. Along the length (preferentially about 2 inches: 50.4 mm) of the extended pre-mix volumes 132 the air and fuel continuing mixing until the mixture is essentially complete. Shortly thereafter, the air/fuel mixtures flows from the extended volumes 132 and passes one of the pilot fuel injectors 122. Because some of the air/fuel mixture passes through a flame front held by the pilot fuel injectors 122 the air/fuel mixture ignites and burns as it flows through the combustion chamber 116.

Figure 2A:
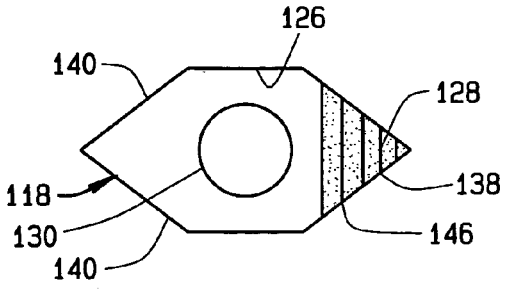

Regarding details of the premix fuel manifolds 118, FIG. 2A illustrates a cross section of the premix fuel manifolds 118 in accordance with the present invention. In particular, a passageway 130 allows fuel to flow from a fuel supply (not shown in FIG. 2A) through the manifold and then out through the pores 128, to reach the onrushing air near the front of the premix fuel manifold 118. Each premix fuel manifold 118 includes a front surface 138 and rear surface 140 which converge with, and diverge from, like surfaces, on adjacent premix fuel manifolds 118 to create the throat 126 of the venturi shaped pre-mix volume 124.

The fuel pores 128 on the front surface 138 may be formed by sintering a series of screens 146 together to form the front surface 138 of the premix fuel manifold 118. Alternatively, the pores 128 may be laser drilled holes formed in the body of the premix fuel manifold 118 with diameters on the order of 0.002 to 0.004 inches (0.0508 mm–0.1016 mm) or smaller.

Additionally, the fuel passageway 130 communicates with an external fuel supply as shown in FIG. 2. In particular, the passageway 130 may communicate with fuel supply 142 if the premix fuel manifold 118 is one of the outer fuel manifolds. Alternatively, the passageway 130 may communicate with the fuel supply 144 if the premix fuel manifold 118 is one of the inner, or core, fuel manifolds. Accordingly, the outer and core premix fuel manifolds 118 may be supplied with fuel independently of each other to allow for turn down operation. More particularly, fuel supply 142 may be shut off to allow the combustor 10 to operate at turn down ratios below about 50%

Figure 3A:
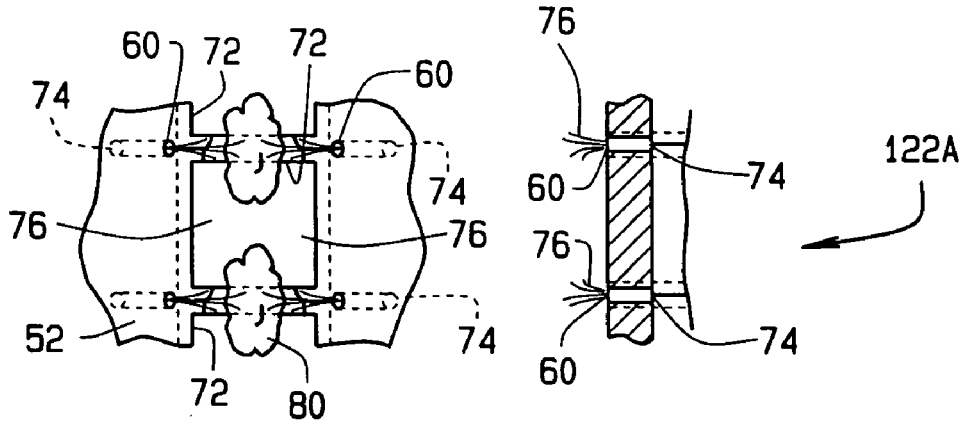
FIG. 3 is a detail view of a pilot fuel injector of the combustor in accordance with the principles of the present invention.
Figure 3B:
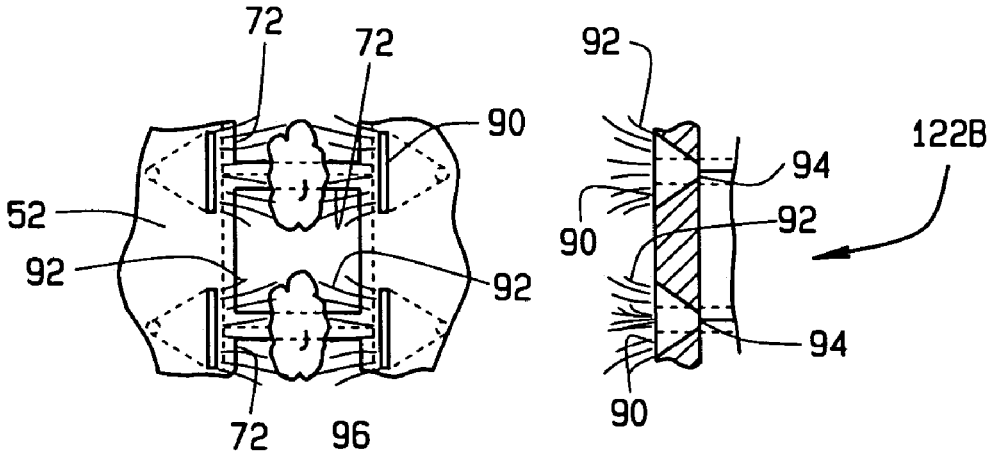
Figure 3C:
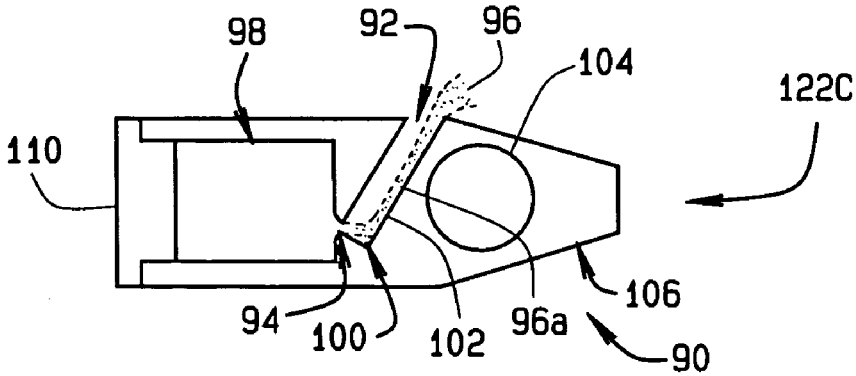

Regarding details of the pilot injectors 122, FIG. 3 shows several pilot fuel injectors 122 in accordance with the principles of the present invention. FIG. 3A through 3C shows fuel injectors 122A through 122C, respectively. Pilot fuel injector 122A is a double impinging injector, pilot fuel injector 122B is a fanformer, and pilot fuel injector 122C is a splash plate injector. The bluff end 150 (see FIG. 2) of the fuel injectors 122A to 122C cause the air/fuel mixture to recirculate in a zone just downstream from the bluff end 150. Accordingly, the pilot fuel injector 122 holds a diffusion flame in the zone that is advantageous for lean combustion stabilization. The average equivalence ratio within these flame holding zones may be adjusted to as high as 0.8 to increase flame holding stability.

With reference to FIG. 3A, air, which acts as an oxidizer, exits from oxidizer pathways 72. As this is happening, fuel exits from injector ports 60 and is transmitted along fuel streams 76. Because the two fuel streams 76 are angled, they intersect at a point downstream of the oxidizer pathways 72 and between the oxidizer pathways 72 in a land region. In one embodiment, the two fuel streams 76 may intersect at an angle of about 90°. When this intersection occurs, the two fuel streams 76 interrupt or intersect each other and produce a fuel plume 80 which spreads into the appropriate oxidizer pathways 72. The fuel plume 80 may be substantially and finely atomized from the fuel streams 76 that are spreading out extremely rapidly. This allows the fuel in the fuel streams 76 to intermix very quickly with the air as it exits the oxidizer pathways 72.

With reference to FIG. 3B, in the various embodiments, air exits the main injector 52 through the oxidizer pathways 72. Fuel streams 76 are also produced as fuel exits a plurality of injector ports 90. The injector ports 90 are not circular, but rather are generally rectangle in shape having a height and a width, wherein the height is substantially greater than the width. The height of the injector port 90 extends substantially parallel to the height of the oxidizer pathways 72. Therefore, a fuel stream or fan 92 is produced by the fuel injectors 90 that is substantially spread out or flattened, as it exits the injector port 90, as opposed to the fuel stream 76 described previously.

Fuel may enter the fuel pathway 74 through any appropriately shaped port, but as the pathway 74 nears the injector port 90, the pathway becomes substantially rectangular having a height that is much greater than the width W. The upstream side of the main injector 52 includes an inlet port 94 that is substantially circular in shape. Nevertheless, the injector port 90 is substantially rectangular in shape. The fuel stream 92 is already substantially spread out or thinned before it reaches an intersection point with another fuel stream 92. As two fuel streams 92 intersect, they produce a fuel plume 96 which allows the fuel provided through the injector ports 90 to be mixed with the air exiting the oxidizer pathways 72.

With reference to FIG. 3C, in a preferred embodiment, the injector element 122C includes a fuel feed cavity 98 through which the fuel is able to flow. Once the fuel is provided to the fuel feed cavity 98 under a pressure, the fuel moves toward and through the injector orifice 94 into the injector slot 92. The fuel fan 96 is formed as a fuel jet 100 exits to the orifice 94 from the fuel feed cavity 98. The fuel jet 100 generally engages a downstream or splash plate portion 102 of the injector element 122C and is spread across the splash plate or splash face 102. As the fuel is spread across the splash face 102, the fuel spreads out such that it exits the injector slot 92 in a substantially open or fanned form. A coolant pathway is provided through a nose, or downstream end, 106 of the injector element 122C. The coolant pathway 104 allows for active cooling of the injector element 122C. Any appropriate coolant including water, an organic coolant, or the like, may be provided through the coolant pathway 104 to assist in cooling the injector element 122C.

The injector orifice 94 may be any appropriate size, for example, about 0.001 to about 0.1 inches (about 0.254 mm to about 2.54 111 m). Additionally, the injector orifice 94 may have any appropriate shape. For example, the injector orifice 94 may be a selected geometrical shape, such as an octagon, or other appropriate polygon. Furthermore, the injector orifice 94 may be a slot substantially equal to the injector slot 92. Therefore, the injector orifice 94 need not simply be circular or round in shape and size, but may be any appropriate size to provide the fuel jet through the injector orifice 94 to engage the splash plate 102. In addition, the length of the orifice 94 may be any appropriate length.

In one preferred embodiment, the pilot fuel injector 122 possesses a width of about the quenching distance (shown in FIG. 2) of the fuel, or greater. More particularly, the pilot fuel injector 122 may possess a thickness of about 0.150 inches (3.81 mm). Additionally, a support structure 134 (shown in FIG. 2) extends in parallel with the sheets 120 to dispose the pilot fuel injector 122 so that the flame held thereby exists at a point near the point of complete air/fuel mixing (i.e., at the exit of the extended volumes 132).

It should be noted that the support structure 134 and the pilot fuel injector 122 fill a volume about that of one of the extended volumes 132. Correspondingly greater air flow (and air velocity) results in the extended volumes 132 adjacent the pilot fuel injector 122. Accordingly, the air/fuel mixing in the adjacent extended volumes 132 exceeds that in the other extended volumes 132. Thus, the pilot arrangement of the present invention provides for combustor 110 startups and operations that are less susceptible to combustion instability.

An end cap 148 (shown in FIG. 2) may be positioned in front of the fuel injector 118' associated with the pilot fuel injector 122. As can be seen in FIG. 2, the premix fuel injector 118' is wider than the other premix fuel injectors 118 to account for the width of the pilot fuel injector 122. Accordingly, the end cap serves to guide the air flow into the premix volumes 124 on either side of the premix fuel injector 118'.

Turning now to the extended premix volumes 132, the sheets 120 are disposed so that the extended volumes 132 will not allow flashback from the combustion chamber 116 to propagate into the extended volumes 132. Accordingly, the distance d1 between adjacent sheets 120 is less than, or at most equal to, about the quenching distance of the fuel employed in the combustor 110. In a preferred embodiment, a 0.150 inch (3.81 mm) gap separates adjacent sheets 120. In another preferred embodiment, a honeycomb insert 136 (shown in FIG. 2) slides into the extended volume 132 to prevent flashback associated with fuels having quite small quench distances such as hydrogen. Thus, the openings of the honeycomb insert 136 have hydraulic diameters less than or about equal to that of the quenching distance of the fuel.

Figure 4:
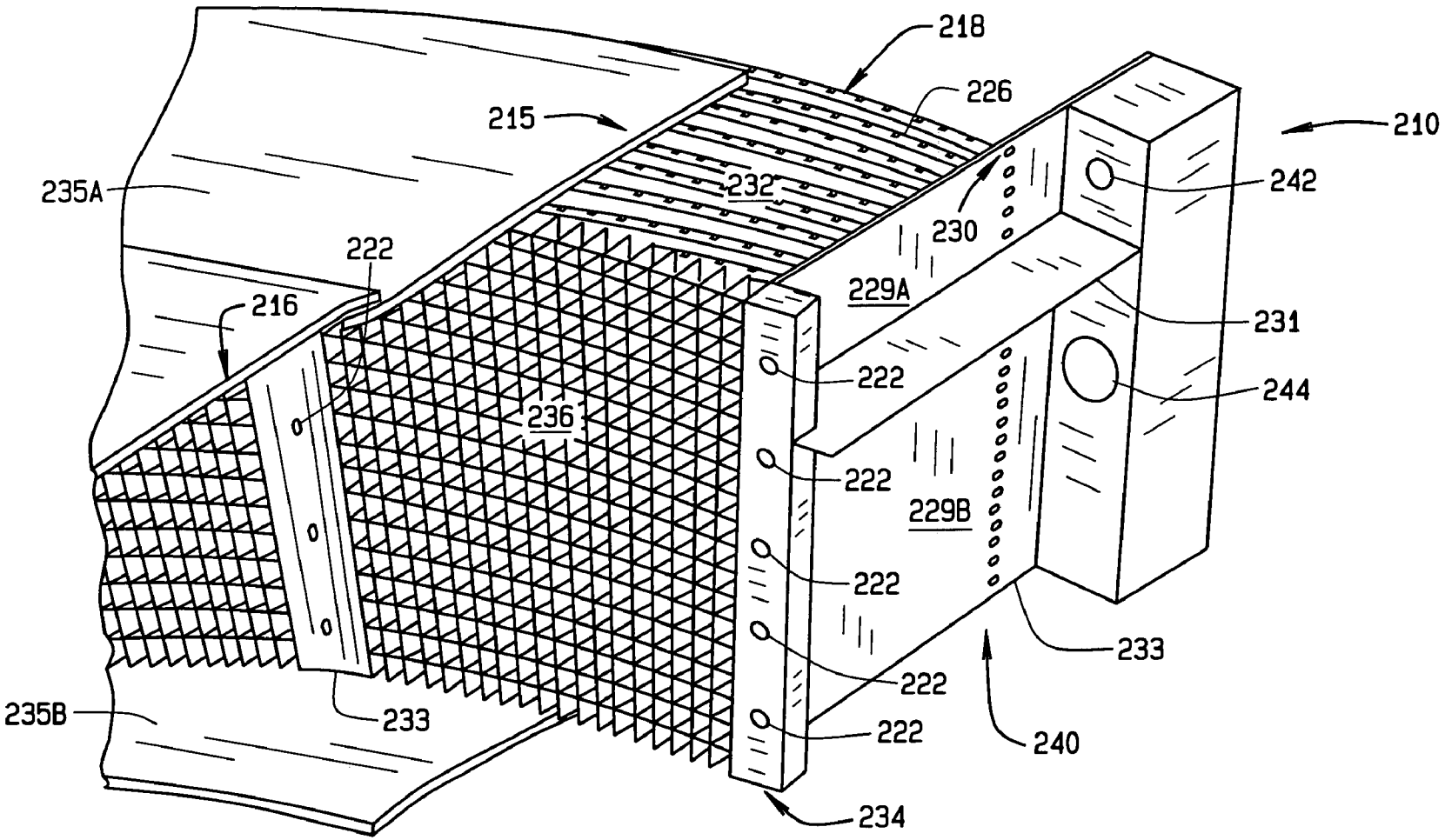
FIG. 4 is a perspective cross sectional view of a combustor in accordance with another preferred embodiment of the present invention.

With Reference now to FIG. 4, a combustor in accordance with another preferred embodiment of the present invention is illustrated. The combustor 210 includes one or more fuel manifolds 218, an extended pre-mix volume 232, a honeycomb insert 236, a fuel sub-system 240, and a series of bluff bodies 234 located upstream of a combustion chamber 216.

The fuel manifolds 218 are disposed concentrically around the center of the combustor 210 with venturi shaped throats 226 therebetween and pores (not shown) disposed at, upstream, or even downstream of the throats 226. Downstream from the fuel manifolds (by a distance pre-determined to allow optimal mixing of the air and fuel), the honeycomb insert 236 prevents flashback from the combustion chamber 216 to the mixing volume 232.

The fuel sub-system 240 includes fuel ports 242 and 244 for connection to one or more external fuel supplies. From the ports 242 and 244, fuel flows into one or more fuel chambers 229A and 229B, from which the fuel flows into the central bores 230 of the fuel manifolds 218. Then the fuel flows through the pores of the fuel manifolds 218 for mixing with the incoming air. Those skilled in the art will recognize that the chambers 229A and 229B may be separated by a gas or liquid barrier 231 to allow for selective fueling of the inner and outer rings of fuel manifolds 218. Thus, the combustor 210 may operate at low turn down ratios without an attendant increase in carbon monoxide (CO) emissions.

Of course, the fuel chamber 229 includes a pair of radial closeouts 233 and a pair of circumferential (e.g., inner and outer) closeouts 235A and 235B to seal the fuel in the chamber 229. Of course, the radial closeouts 233, manifolds 218, insert 236, and circumferential closeouts 235 define the pre-mix volume 232.

Turning now to the bluff body 234, the bluff body 234 may include one or more pilot injectors 222 in communication with a fuel chamber 229. It will be recognized that the radial bluff bodies 234 provide a downstream wake for holding the flame provided by the pilot injectors 222. Of course, if fuel is shut off to a particular fuel chamber 229A, the injectors 222 associated with that chamber 229A will be turned off along with the manifolds 218 associated with the chamber 229A. Accordingly, the present embodiment provides a combustor 210 that is convenient to manufacture.

As those skilled in the art will appreciate, the present invention reduces NOx and CO emissions to less than 10 ppm at both full power and reduced power operating conditions. More particularly, the present invention reduces NOx and CO emissions to between about 3 and about 10 ppm, respectively. Additionally, the present invention provides greater acoustic stability for low pressure drop gas turbine combustors. In addition, the present invention also eliminates detrimental flashback and the associated hardware failures of the prior art swirler combustors. Accordingly, combustors in accordance with the principles of the present invention also enjoy better performance and longer life.

Moreover combine cycle gas turbine combustor systems (using steam turbine bottoming cycles) in accordance with the present invention possess thermal efficiency approaching 60% whereas many previous steam power plants possess thermal efficiency of about 35% at best. Thus, in addition to power generation, the present invention may be incorporated into many other land and marine applications wherein fuel efficiency is desired. Additionally, a the present invention provides systems and methods to burn essentially pure hydrogen fuel using very high air premix flame speeds thereby offering improved reliability over that of the conventional swirler injectors.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. A fuel injector for a gas turbine combustor, comprising:

a first annular premix fuel manifold adapted to be disposed upstream of the combustor; and an annular member concentric with the first annular premix fuel manifold and defining a first venturi shaped air/fuel pre-mix volume between the first annular premix fuel manifold and the annular member, the first venturi shaped pre-mix volume having a throat, the first annular premix fuel manifold including a plurality of pores associated with the throat;

and wherein fuel is to be injected from the first annular premix fuel manifold for mixing with air in the first venturi shaped pre-mix volume.

2. The injector according to claim 1, wherein the annular member further comprises an outer wall disposed to enclose the first annular premix fuel manifold and adapted to be coupled to the combustor.

3. The injector according to claim 1, wherein the annular member further comprises a second annular premix fuel manifold.

4. The injector according to claim 1, further comprising a sheet extending downstream from the first annular premix fuel manifold; and wherein the first venturi shaped pre-mix volume extends downstream from the first annular premix fuel manifold.

5. The injector according to claim 4, wherein the injector comprises a premix injector about 2 inches (50.4 mm) long.

6. The injector according to claim 1, further comprising a pilot injector disposed downstream from the first annular premix fuel manifold.

7. The injector according to claim 6, wherein the pilot injector comprises one of a fanformer, a splash plate, and an impinging doublet type fuel injector.

8. The injector according to claim 1, wherein the plurality of pores comprise holes having diameters between about 0.002 and about 0.004 inches (0.508 mm–0.1016 mm).

9. The injector according to claim 1 further comprising the first venturi shaped pre-mix volume extending downstream from the throat and having a width downstream of the throat less than about a quench distance of the fuel.

10. A gas turbine combustor, comprising:

a combustion chamber;

a first annular premix fuel manifold disposed upstream of the combustion chamber; and an annular member concentric with the first annular premix fuel manifold and defining a first venturi shaped air/fuel pre-mix volume between the first annular premix fuel manifold and the annular member, the first venturi shaped pre-mix volume having a throat, the first annular premix fuel manifold including a plurality of pores approximately upstream of the throat; and wherein fuel is to be injected from the first annular premix fuel manifold for mixing with air in the first venturi shaped pre-mix volume.

11. The combustor according to claim 10, wherein the annular member further comprises an outer wall of the injector disposed to enclose the first annular premix manifold and adapted to be coupled to the combustor.

12. The combustor according to claim 10, wherein the annular member further comprises a second annular premix fuel manifold.

13. The combustor according to claim 12, further comprising a first and a second premix fuel supply in communication with the first and the second premix annular fuel manifolds respectively.

14. The combustor according to claim 10, further comprising a sheet extending downstream from the first annular premix fuel manifold whereby the first venturi shaped pre-mix volume extends downstream from the first premix fuel manifold.

15. The combustor according to claim 14, wherein the injector is about 2 inches long (50.4 mm).

16. The combustor according to claim 10, further comprising a pilot injector disposed downstream from the first annular premix fuel manifold.

17. The combustor according to claim 16, wherein the pilot injector comprises one of a fanformer, a splash plate, and an impinging doublet type fuel injector.

18. The combustor according to claim 10, wherein the plurality of pores comprise holes having diameters between about 0.002 and about 0.004 inches (0.0508 mm–0.1016 mm).

19. The combustor according to claim 10, further comprising the first venturi shaped pre-mix volume extending downstream from the throat and having a width downstream of the throat less than about a quench distance of the fuel.

20. A method of pre-mixing air and fuel for a gas turbine combustor, comprising:

defining a first venturi shaped pre-mix volume between a first annular premix fuel manifold and an annular member, the first venturi shaped pre-mix volume having a throat; and injecting fuel from the first annular premix fuel manifold through a plurality of pores in the first annular premix fuel manifold approximately upstream of the throat; and mixing the fuel with air in the first venturi shaped pre-mix volume.

21. The method according to claim 20, further comprising using the annular member as an outer wall to enclose the first annular premix fuel manifold.

22. The method according to claim 20, using the annular member further as a second annular premix fuel manifold.

23. The method according to claim 22, further comprising placing a first and a second premix fuel supply in communication with the first and the second annular premix fuel manifolds respectively.

24. The method according to claim 20, further comprising extending a sheet downstream from the first annular premix fuel manifold and less than about a quench distance of the fuel from the annular member thereby extending the first venturi shaped pre-mix volume downstream from the first annular premix fuel manifold.

25. The method according to claim 24, wherein the injector is about 2 inches (50.4 mm) long.

26. The method according to claim 20, further comprising disposing a pilot injector downstream from the first annular premix fuel manifold.

27. The method according to claim 26, wherein the pilot injector comprising one of a fanformer, a splash plate, or an impinging doublet type fuel injector.

28. The method according to claim 20, wherein the plurality of pores comprise holes having diameters between about 0.002 and about 0.004 inches (0.0508 mm–0.1016 mm).

* * * * *